US007116205B2

(12) United States Patent
Hsueh et al.

(10) Patent No.: US 7,116,205 B2
(45) Date of Patent: Oct. 3, 2006

(54) TRANSFORMER AND VOLTAGE SUPPLY CIRCUIT THEREOF FOR LIGHTING TUBES

(75) Inventors: Ching-Fu Hsueh, Taoyuan (TW); Wan-Chin Hsu, Taoyuan (TW); Chih-Shin Huang, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 169 days.

(21) Appl. No.: 10/799,065

(22) Filed: Mar. 12, 2004

(65) Prior Publication Data

US 2004/0183448 A1 Sep. 23, 2004

(30) Foreign Application Priority Data

Mar. 19, 2003 (TW) ..... 92106065 A

(51) Int. Cl.
*H01F 27/30* (2006.01)
*H05B 41/16* (2006.01)

(52) U.S. Cl. ..... 336/212; 336/198; 315/276; 315/DIG. 5

(58) Field of Classification Search ..... 336/212, 336/198, 208; 315/212, 291, 312, 219, 276, 315/224–226, 360, 209 R, DIG. 5, DIG. 7
See application file for complete search history.

(56) References Cited

U.S. PATENT DOCUMENTS 3,947,749 A * 3/1976 Kimura et al. ..... 363/126
4,016,477 A * 4/1977 Ghiringhelli ..... 363/64
6,717,372 B1 * 4/2004 Lin et al. ..... 315/282

FOREIGN PATENT DOCUMENTS

JP 08236362 A * 9/1996

* cited by examiner

*Primary Examiner*—Anh Mai
(74) *Attorney, Agent, or Firm*—Quintero Law Office

(57) ABSTRACT

A transformer. The transformer drives a plurality of lighting tubes and comprises a coupling iron core, a first winding around the coupling iron core, a first bobbin disposed between the first winding and the coupling iron core, a plurality of second windings, independent of each other and respectively winding around the exterior of the first winding, wherein the second windings have the same winding number, and a second bobbin disposed between the first winding and one second winding.

13 Claims, 10 Drawing Sheets

TRANSFORMER AND VOLTAGE SUPPLY CIRCUIT THEREOF FOR LIGHTING TUBES

BACKGROUND OF THE INVENTION

1. Field of the Invention

The present invention relates to a transformer, and in particular to a transformer voltage supply circuit thereof, applied to tubes, balancing the currents thereof.

2. Description of the Related Art

In the rapid development of display technology, liquid crystal display (LCD) monitors have been very common. Over traditional cathode ray tube (CRT) monitors, LCD monitors have had advantages of smaller thickness, fewer occupying space, and more stable screen without flicker. An LCD monitor has a backlight module, comprising lighting tubes driven by high voltage. Generally, this kind of lighting tube is driven by an inverter including a driving circuit and a high voltage transformer. To decrease the volume of LCD monitors, the transformer inside the inverter is designed as thin and small as possible.

Currently, many kinds of displays, for example, LCD monitors, prefer highly efficient, light, and smaller lighting tubes as backlight. Cold cathode fluorescent lamps (CCFL) have been commonly used, and, as dimensions of the monitor increase, backlight modules use a plurality of lighting tubes, rather than a single lighting tube, to supply satisfactory brightness.

In a conventional transformer of an inverter, primary windings and secondary windings are wound around a hollow bobbin with an iron core disposed inside. FIG. 1*a* shows an embodiment of the conventional transformer applied in an inverter. FIG. 1*b* is a cross-section of a bobbin with windings in the conventional transformer in FIG. 1*a*.

As shown in FIG. 1*a*, the conventional transformer 10 of the inverter includes a first E-shaped iron core 122 and a second E-shaped iron core 121. The first iron core 122 and the second iron core 121 function together to form a closed magnetic circuit. In addition, the conventional transformer includes a bobbin 13. The bobbin 13 has a primary winding window 131 and a secondary winding window 133. A plurality of metal pins 135 at two ends of the bobbin 13 connect and weld conduction cords of the windings to a circuit board. A separator 132 is disposed between the primary winding window 131 and the secondary winding window 133. In addition, the secondary winding window 133 is divided into several winding areas by separators 134.

As shown in FIG. 1*b*, in the structure of the bobbin, the primary winding window 131 is used for a primary winding 141, and the secondary winding window 133 for a secondary winding 142. The secondary winding 142 has a relatively small diameter and a relatively larger winding number. When wound in multiple layers, the voltage difference between conduction cords in adjacent layers can be high enough to cause arcing. To avoid this, the separators 134 usually separate the secondary winding window 133 into several winding areas.

However, because the primary windings and the secondary windings are wound around the same bobbin, the conventional transformer can experience some problems.

For example, when only a single transformer drives more than two lighting tubes, the load power of the conventional transformer increases such that the temperature of the primary windings increases, raising the temperature of the transformer to unacceptable levels. While this problem can be solved by increasing the diameter of the conduction cords of the primary winding, the volume of the transformer increases accordingly, such that this is not an ideal solution.

FIG. 2 shows a conventional voltage supply circuit for lighting tubes. The voltage supply circuit includes a driving circuit 21, a transformer 22, capacitors C1 and C2, a balance circuit 23, and lighting tubes 251 and 252. The transformer 22 includes a primary winding 221, a secondary winding 222, and an iron core 223. The driving circuit 21 supplies a low voltage signal to the primary winding 221 of the transformer 22, and the secondary winding 222 inductively generates a high voltage signal to drive lighting tubes 251 and 252. Due to impedance and stray capacitance of the conduction cord, current through the lighting tubes 251 and 252 is not the same. Thus, the lighting tubes 251 and 252 have different brightness, thus degrading the display quality. A balance circuit 23 is then necessary to normalize current through the lighting tubes 251 and 252.

FIG. 3 shows another conventional voltage supply circuit for lighting tubes. The two conventional voltage supply circuits for lighting tubes in FIG. 3 and 2 differ in the disposition of the balance circuit 33, which is connected between the ground and the lighting tubes 251 and 252.

In conventional voltage supply circuits for lighting tubes, because the transformer 22 includes only two windings for high voltage and low voltage respectively, methods of driving the lighting tubes include serial tubes, parallel tubes, and multiple transformers. Serial tubes balance the current, but the transformer is still vulnerable to high voltage. An additional balance circuit is necessary when connecting lighting tubes in parallel. Multiple transformers increase cost and space used. Thus, none of the three methods provides an ideal solution.

SUMMARY OF THE INVENTION

Accordingly, the present invention provides a transformer, driving a plurality of lighting tubes, comprising a coupling iron core, a first winding around the coupling iron core, a first bobbin disposed between the first winding and the coupling iron core, a plurality of second windings, independent of each other and respectively winding around the exterior of the first winding, wherein the second windings have the same winding number, and a second bobbin is disposed between the first winding and one second winding.

The present invention also provides a voltage supply circuit for a plurality of lighting tubes, comprising a coupling iron core, a first winding around the coupling iron core receiving a first voltage signal, a first bobbin disposed between the first winding and the coupling iron core, a second winding around the exterior of the first winding inductively generating a second voltage signal, a second bobbin disposed between the first winding and the second winding, and a plurality of lighting tubes is driven by the second voltage signal.

The present invention also provides another voltage supply circuit for a plurality of lighting tubes, comprising a coupling iron core, a first winding around the coupling iron core for receiving a first voltage signal, a plurality of second windings, independent of each other, respectively winding around the exterior of the first winding, and inductively generating a plurality of second voltage signals, wherein the second windings have the same winding number, a second bobbin is disposed between the first winding and the second winding, and a plurality of lighting tubes is respectively driven by the second voltage signals.

The transformer of the present invention utilizes double layers of bobbins to provide several winding configurations to satisfy the specifications of various circuit structures. When applied in a voltage supply circuit for lighting tubes, the transformer balances output current of CCFLs, ensuring even brightness and lighting tubes of longer duration.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 4:
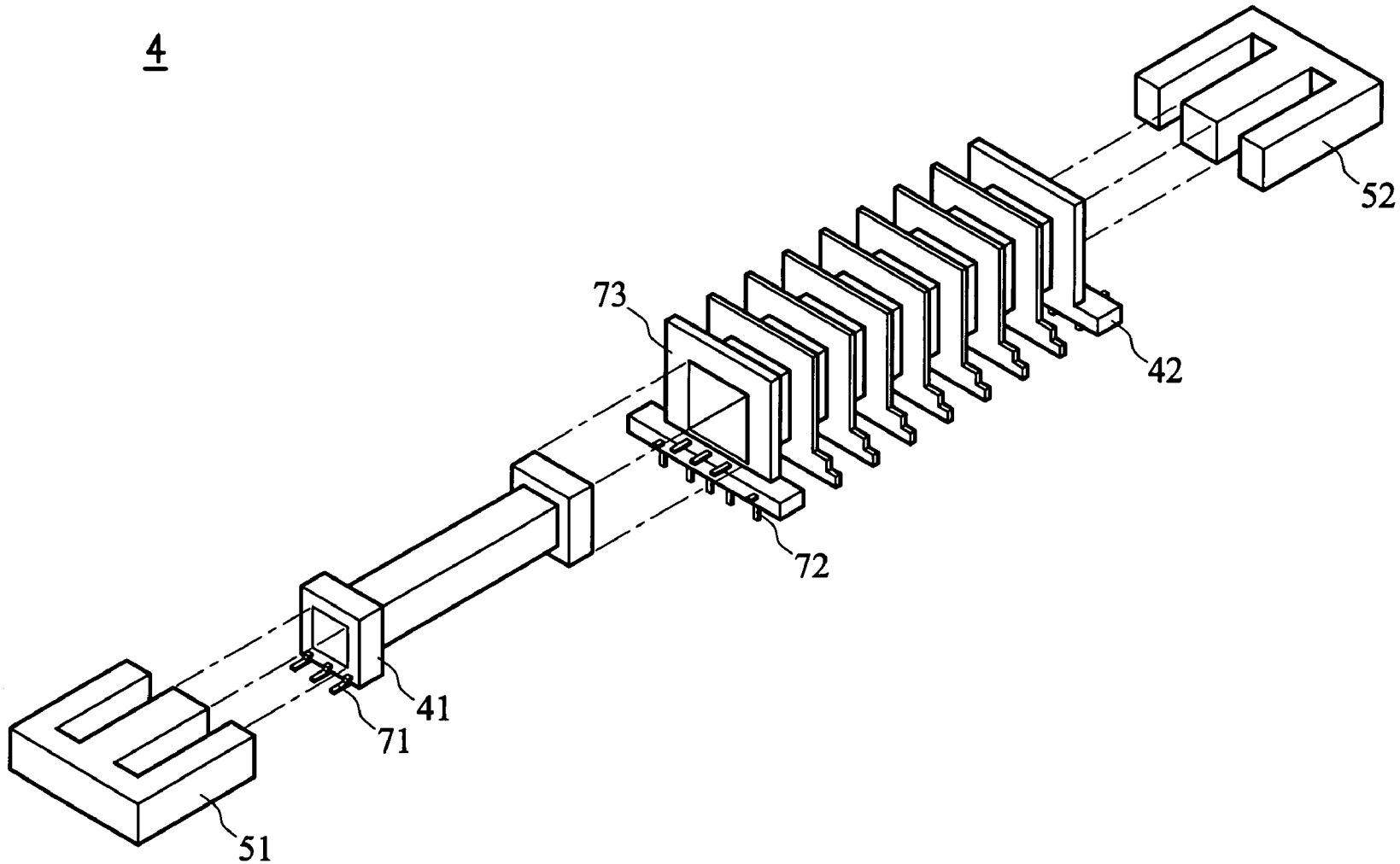
FIG. 4 is an exploded diagram of the structure of the transformer of the present invention before windings are configured.

FIG. 4 is an exploded diagram of the structure of the transformer of the present invention before windings are configured. The transformer 4 of the present invention includes a first bobbin 41 with a primary winding (not shown in drawings), a second bobbin 42 with a secondary winding (not shown in drawings), and an iron core 50, wherein primary winding pins 71 are disposed at both ends of the first bobbin 41, secondary winding pins 72 are disposed at both ends of the second bobbin 42, and the second bobbin 42 encloses the first bobbin 41. A plurality of separators 73 are disposed around the exterior of the second bobbin 42, with the separation thereof accommodating the secondary winding (not shown in drawings) and preventing arcing by also separating conduction cords. The iron core 50 through the first bobbin 41 comprises two E-shaped coupling iron cores 51 and 52.

Figure 1A:
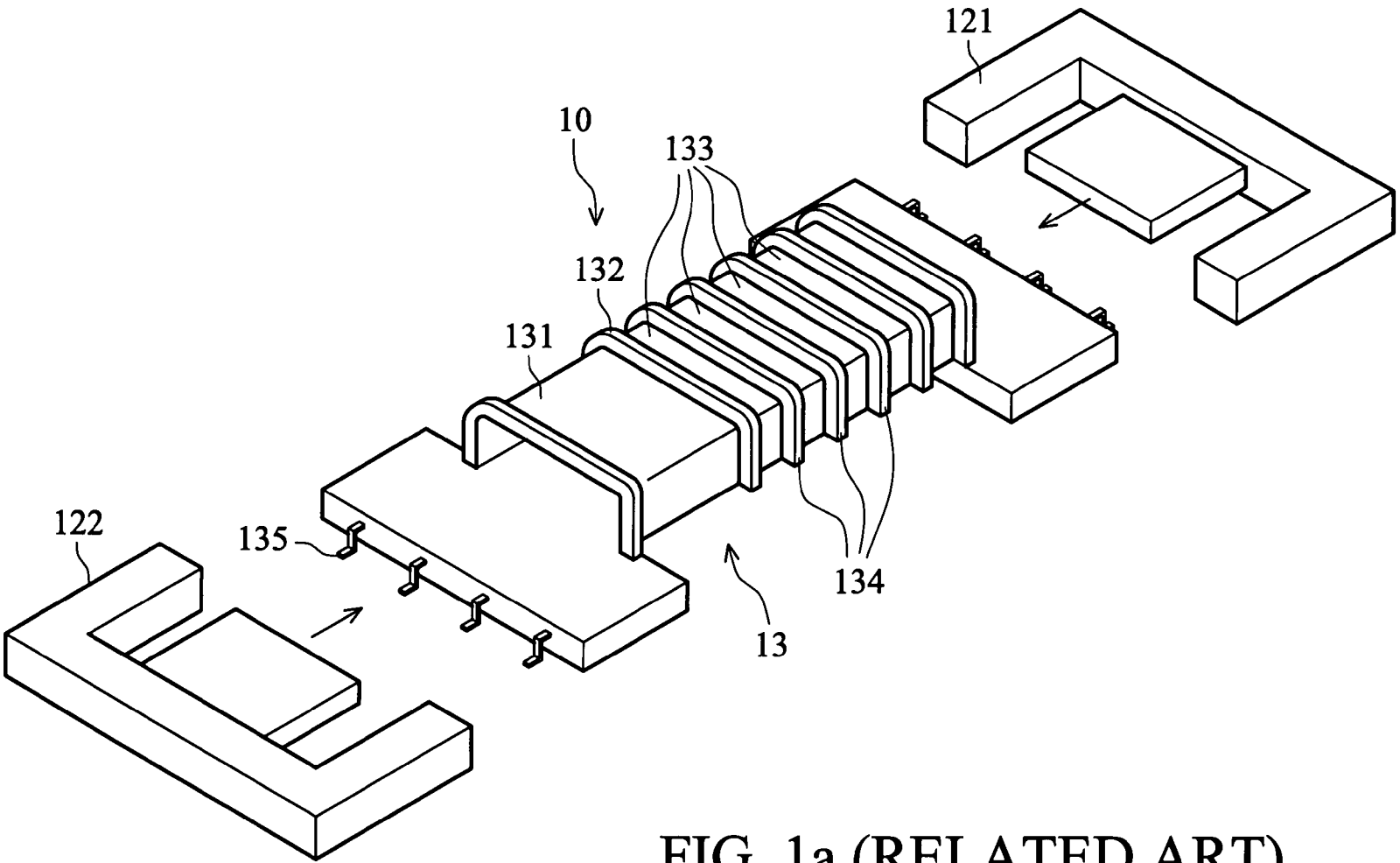
FIG. 1a (RELATED ART)
FIG. 1*a* is an exploded diagram of the structure of the conventional transformer.
Figure 1B:
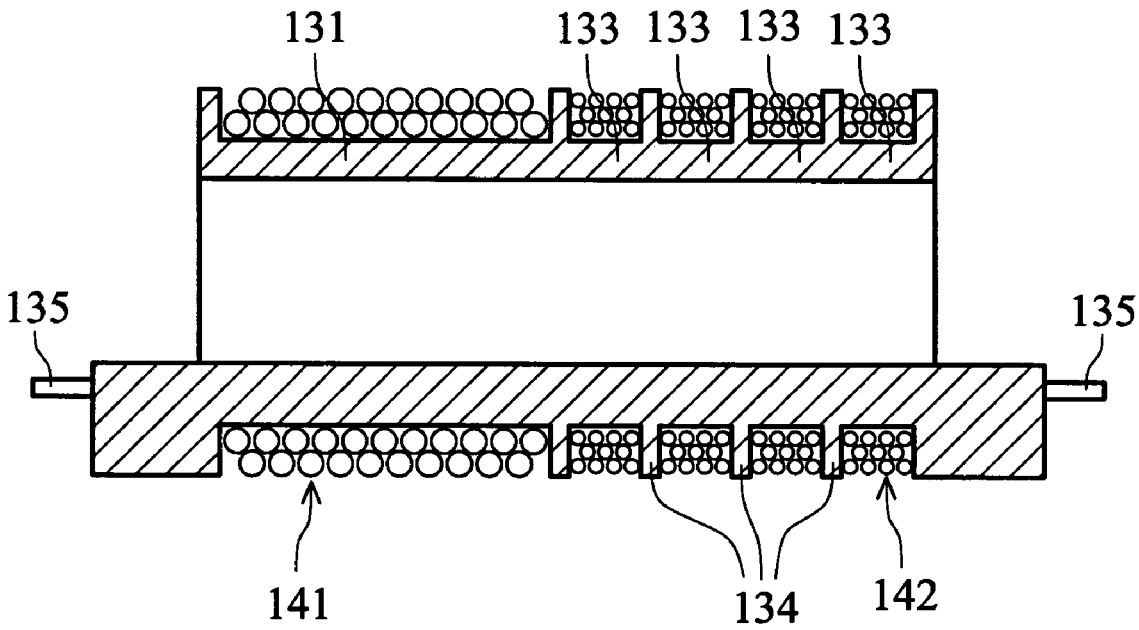
FIG. 1b (RELATED ART)
FIG. 1*b* is a cross-section of the transformer in FIG. 1*a* after combination.
Figure 2:
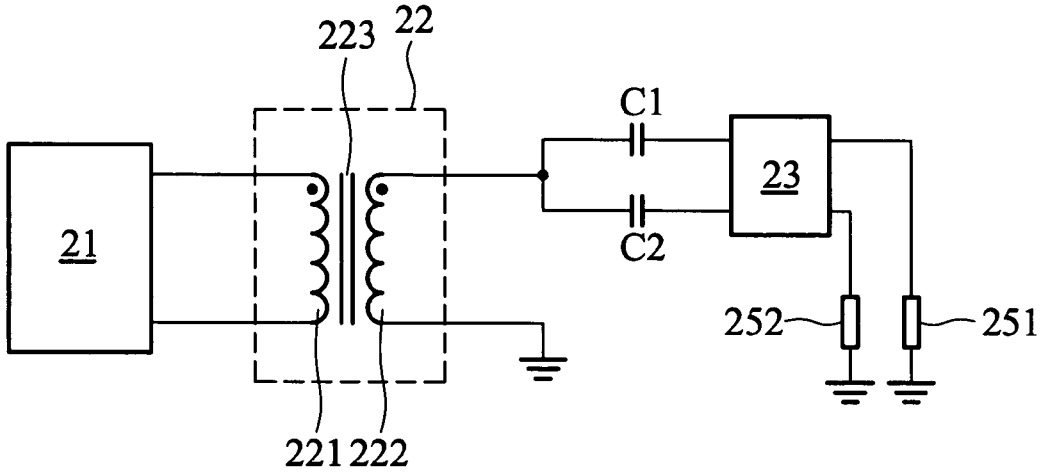
FIG. 2 (RELATED ART)
FIG. 2 shows a conventional voltage supply circuit for lighting tubes.
Figure 3:
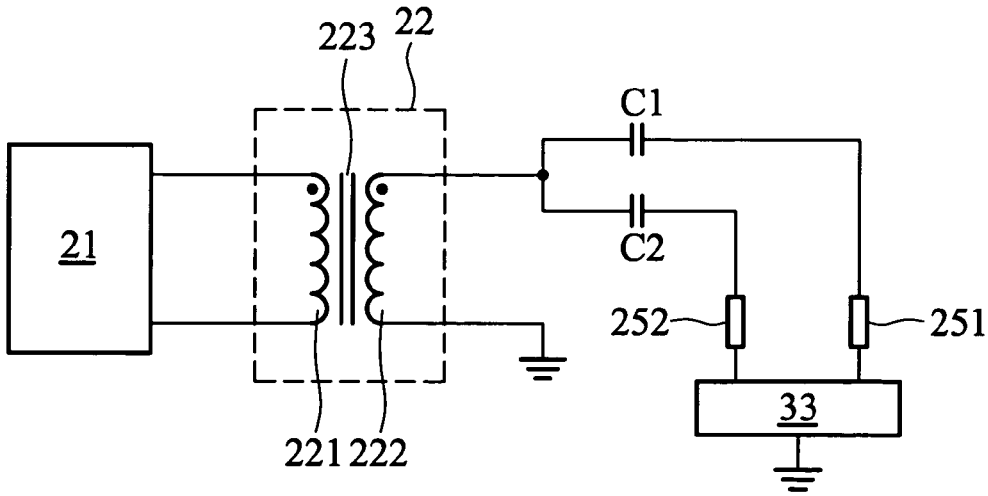
FIG. 3 (RELATED ART)
FIG. 3 shows another conventional voltage supply circuit for lighting tubes.
Figure 5B:
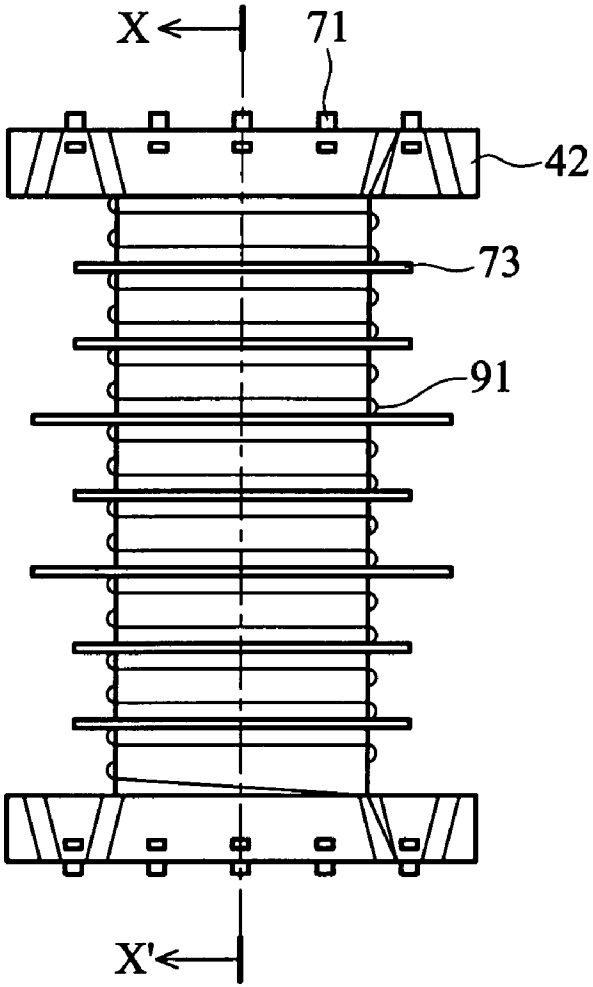
FIG. 5*b* shows the second bobbin of the transformer of the present invention according to one winding method.
Figure 5A:
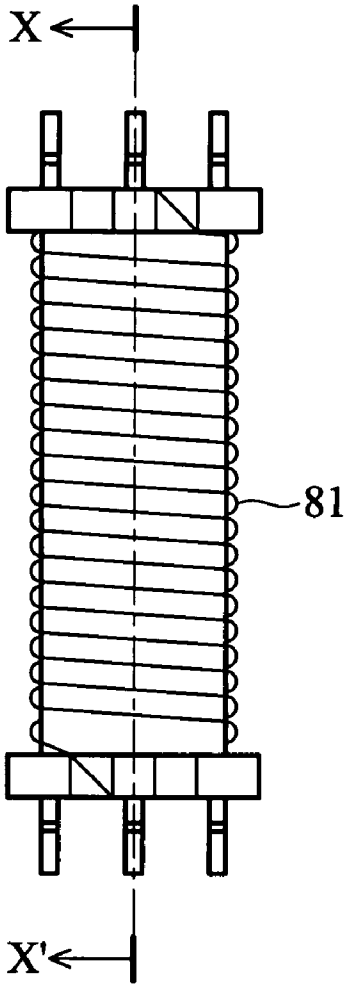
FIG. 5*a* shows the first bobbin of the transformer of the present invention according to one winding method.
Figure 6:
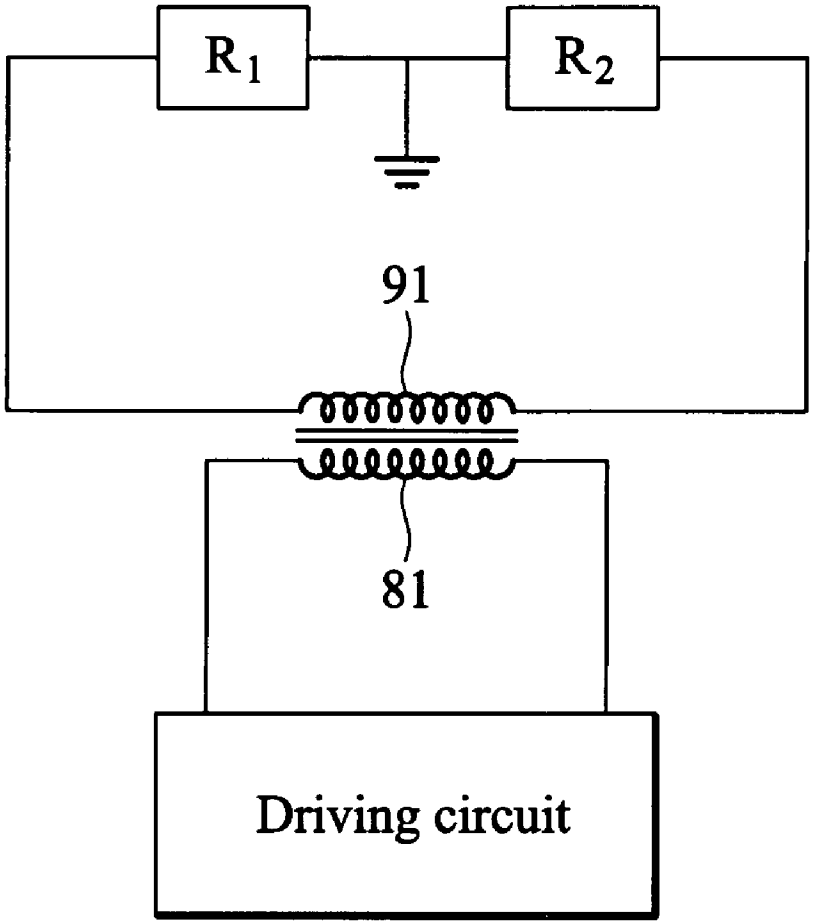
FIG. 6 shows the effective circuit of the voltage supply circuit for lighting tubes utilizing the transformer in FIGS. 5*a* and 5*b*.

FIGS. 5*a* and 5*b* show one winding method for primary and secondary windings of the transformer of the present invention. As shown in FIGS. 5*a* and 5*b*, the primary winding is formed by a first winding 81 around the first bobbin 41, and the secondary winding is formed by a second winding 91 around the second bobbin 42. FIG. 6 shows the effective circuit of the voltage supply circuit for lighting tubes utilizing the transformer in FIGS. 5*a* and 5*b*. If the second winding 91 is connected in series with lighting tubes $R_1$ and $R_2$, only single current flows through, such that the current flowing through the secondary winding to be output to the lighting tubes is balanced automatically. Thus, a balance circuit is unnecessary. Compared with the conventional transformer (FIG. 1), the secondary winding provides increased space in winding for more separators 73, thereby avoiding the arcing problem.

Figure 7B:
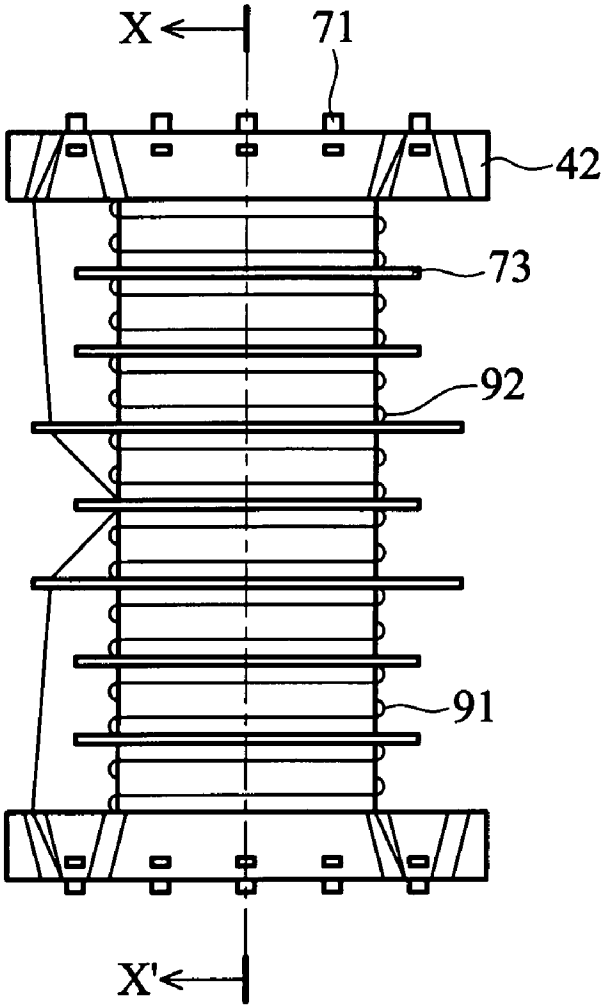
FIG. 7*b* shows the second bobbin of the transformer of the present invention according to the second winding method.
Figure 7A:
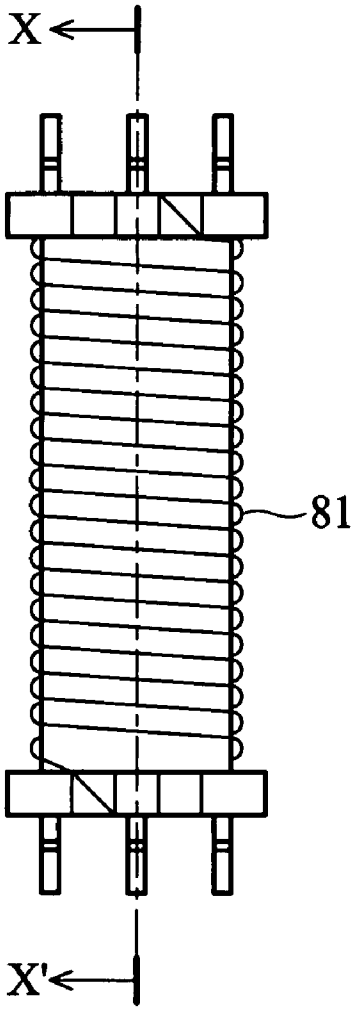
FIG. 7*a* shows the first bobbin of the transformer of the present invention according to another winding method.
Figure 8:
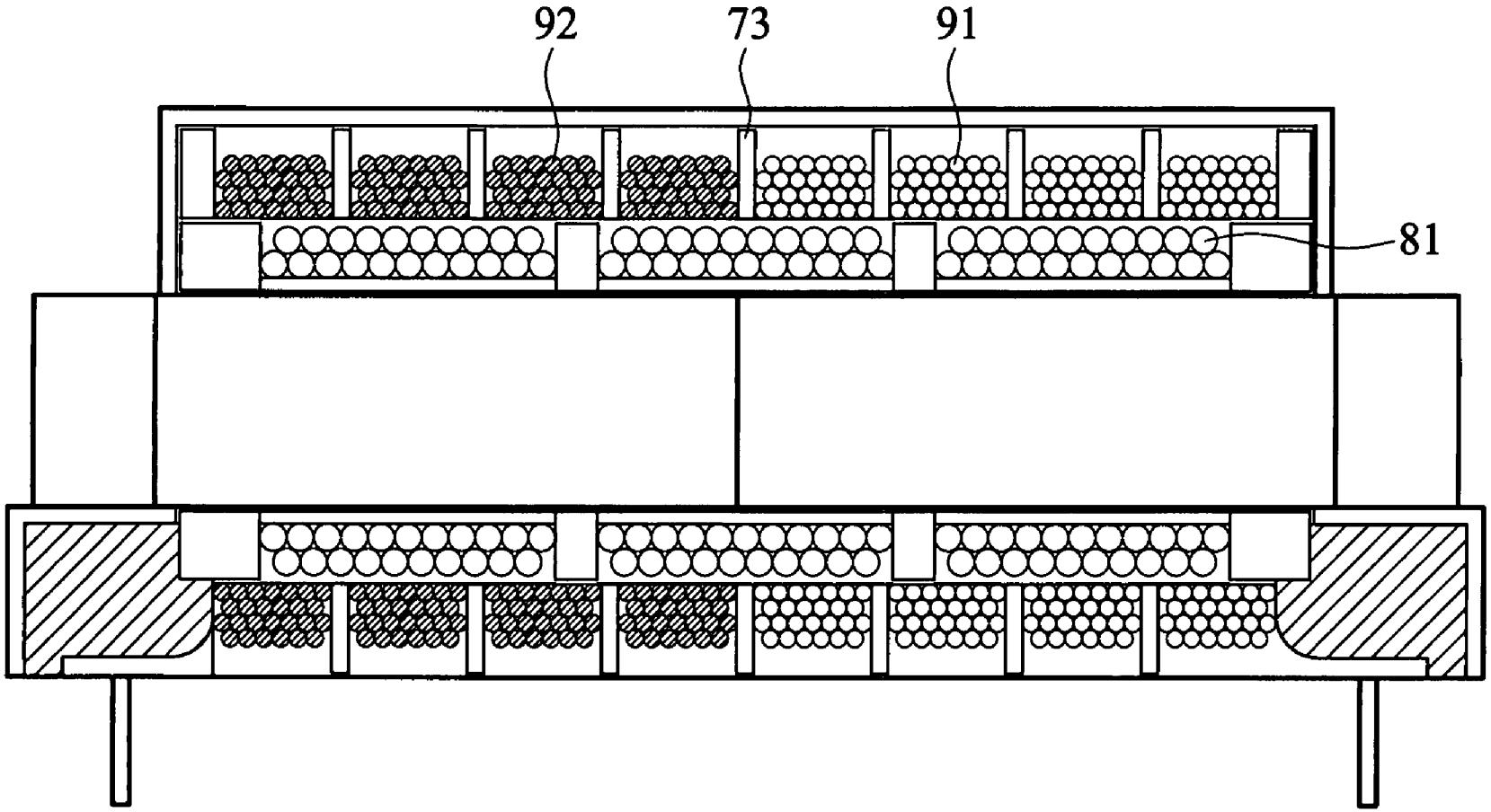
FIG. 8 is a X–X' cross-section of the combination of bobbins in FIGS. 7*a* and 7*b*.

FIGS. 7*a* and 7*b* show another winding method for primary and secondary windings of the transformer of the present invention. As shown in FIGS. 7*a* and 7*b*, the primary winding is formed by a first winding 81 around the first bobbin 41, and the secondary winding is formed by a second winding 91 and a third winding 92 around the second bobbin 42. To achieve current balance, the second winding 91 and the third winding 92 of the secondary winding are disposed independent of each other and have the same winding number. According to Faraday's Law and Lenz's Law, even numbers of secondary windings use the same iron core and have the same winding number, so they have the same magnetic flux and direction. Thereby, current through the secondary winding for output is balanced automatically. A balance circuit is unnecessary. FIG. 8 is a X–X' cross section of the combination of the bobbins in FIGS. 7*a* and 7*b*.

While FIGS. 7*a*, 7*b*, and 8 disclose one winding configuration of the primary and secondary windings of the transformer of the present invention, the invention is not limited thereto. In the transformer of the present invention, the primary winding can be changed according to type of circuit of the connected voltage supply sources, for use in different situations. Thus, winding configurations of a fourth or a fifth winding around the first bobbin can be increased to receive a plurality of input voltage signals. The transformer has a plurality of primary windings and secondary windings, for specific driving circuits.

Figure 9A:
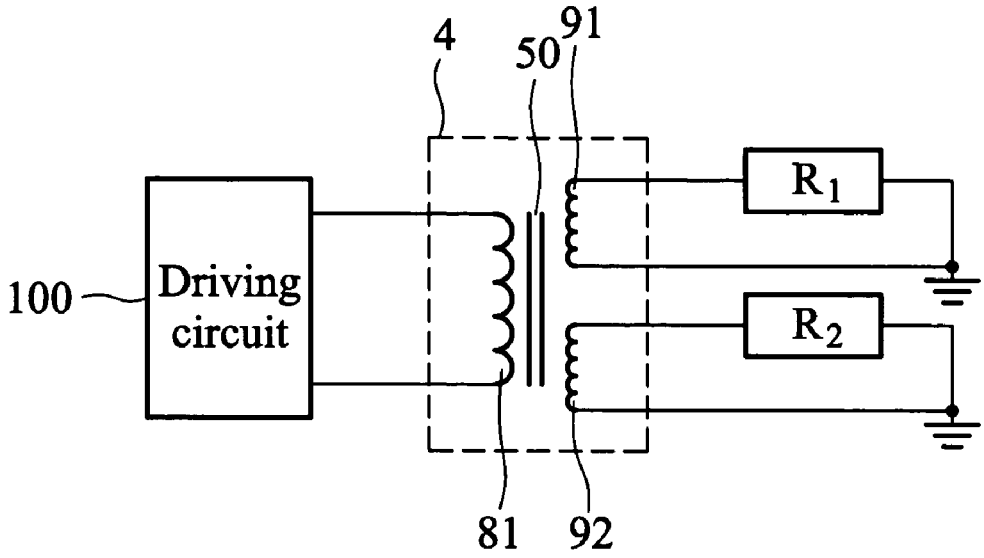
FIG. 9*a* shows an effective circuit of the voltage supply circuit for lighting tubes utilizing the transformer in FIGS. 5*a* and 5*b*.
Figure 9B:
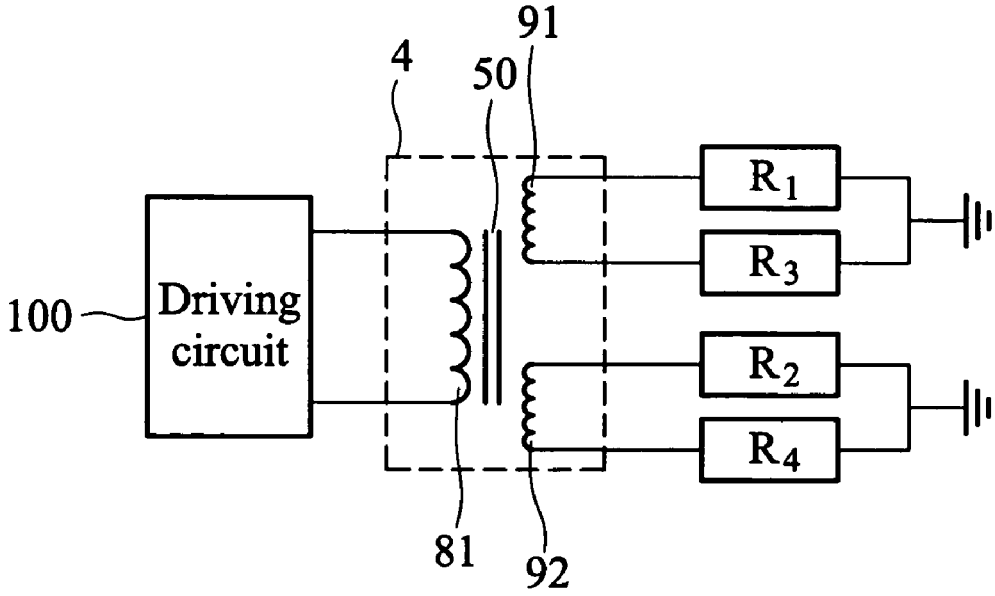
FIG. 9*b* shows an effective circuit of the voltage supply circuit for lighting tubes utilizing the transformer in FIGS. 5*a* and 5*b*.

In the following descriptions, for convenience and simplicity, common elements in all FIGS. use the same labels. FIG. 9*a* shows an effective circuit of the voltage supply circuit for lighting tubes utilizing the transformer of the present invention. The voltage supply circuit for lighting tubes includes a driving circuit 100, a transformer 4, and discharge lighting tubes $R_1$ and $R_2$. The transformer 4 includes a first winding 81, a second winding 91, a third winding 92, and an iron core 50. The first winding 81 receives low voltage signals from the driving circuit 100. Secondary windings, including the second winding 91 and the third winding 92, inductively generate high voltage signals respectively through the first winding 81 and the iron core 50. The high voltage signals drive the lighting tubes $R_1$ and $R_2$ respectively. The discharge lighting tubes $R_1$ and $R_2$ can be CCFLs. The lighting tubes $R_1$ and $R_2$ are coupled with the second winding 91 and the third winding 92 respectively. The second winding 91 and the third winding 92 have the same winding number. FIG. 9*b* shows another effective circuit of the voltage supply circuit for lighting tubes utilizing the transformer of the present invention. The second winding 91 is connected in serial with two lighting tubes $R_1$ and $R_3$, and the third winding 92 is connected in serial with two lighting tubes $R_2$ and $R_4$. Output current from the second winding 91 and the third winding 92 is balanced automatically according to Lenz's Law. Current through the lighting tubes is balanced automatically as currents of the same winding remain the same.

Figure 10:
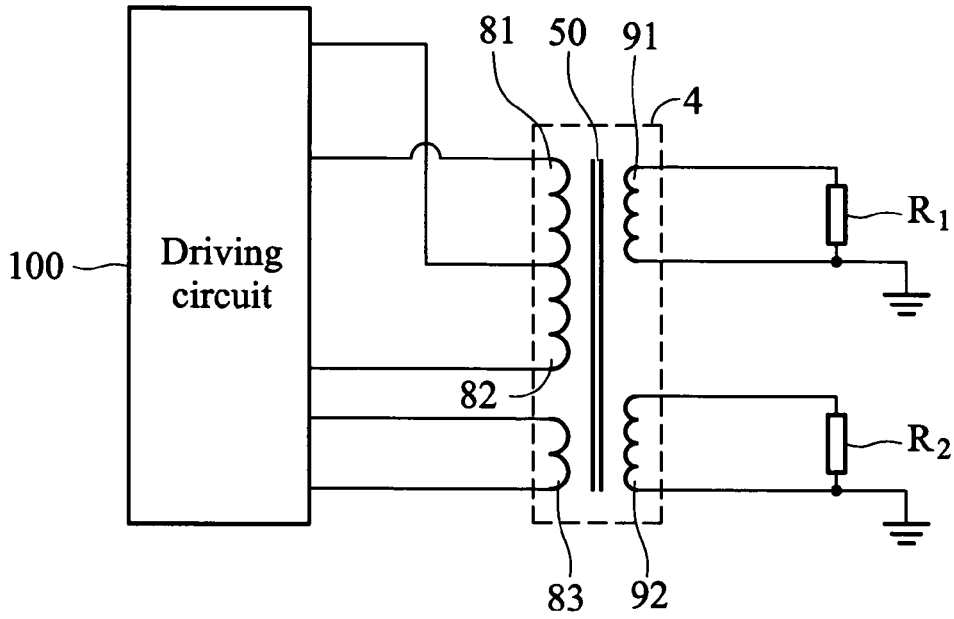
FIG. 10 shows the effective circuit of another voltage supply circuit for lighting tubes utilizing the transformer of the present invention.

FIG. 10 shows the effective circuit of another voltage supply circuit for lighting tubes utilizing the transformer of the present invention. The voltage supply circuit for lighting tubes includes a driving circuit 100, a transformer 4, and discharge lighting tubes $R_1$ and $R_2$. The transformer 4 includes a primary winding, a secondary winding, and an iron core 50, wherein the primary winding includes a first winding 81, a fourth winding 82, and a fifth winding 83, the secondary winding includes a second winding 91 and a third winding 92. The first winding 81 is connected with the fourth winding 82. The first winding 81, the fourth winding 82, and the fifth winding 83 receive voltage signals. The second winding 91 and the third winding 92 inductively generate high voltage signals through the first winding 81, the fourth winding 82, and the fifth winding 83 respectively. The high voltage signals drive the lighting tubes $R_1$ and $R_2$ respectively. The discharge lighting tubes $R_1$ and $R_2$ can be CCFLs. The second winding 91 and the third winding 92 have the same winding number.

Figure 11:
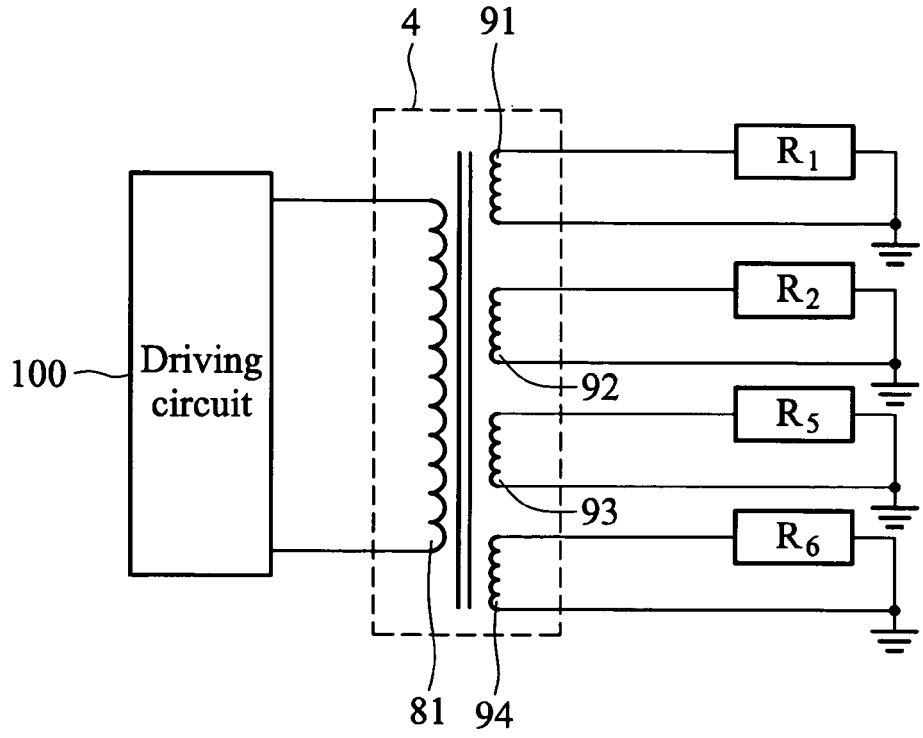
FIG. 11 shows the effective circuit of still another voltage supply circuit for lighting tubes utilizing the transformer of the present invention.

FIG. 11 shows the effective circuit of still another voltage supply circuit for lighting tubes utilizing the transformer of the present invention. The two voltage supply circuits for lighting tubes in FIGS. 11 and 9 differ in the number of secondary windings. In FIG. 11, the voltage supply circuit for lighting tubes includes four secondary windings (windings 91, 92, 93, and 94) for driving four discharge lighting tubes $R_1$, $R_2$, $R_5$, and $R_6$. All secondary windings have the same winding number.

In conclusion, the transformer of the present invention is applied in a supply circuit for driving a plurality of lighting tubes. The secondary windings of the transformer of the present invention, using the same iron core, balance current through the lighting tubes automatically, such that no balance circuit or increase in the number of transformers is needed.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A transformer for a plurality of lighting tubes, comprising:

a coupling iron core;

a first winding around the coupling iron core;

a first bobbin disposed between the first winding and the coupling iron core;

a plurality of second windings, independent of each other and respectively winding around the exterior of the first winding, wherein the second windings have the same winding number;

a second bobbin disposed between the first winding and one second winding; and a third winding disposed between the first bobbin and the second bobbin, wherein the plurality of second windings generate high voltage signals induced from the first winding and the third winding;

wherein each pair of the plurality of lighting tubes is connected in series and driven by one of the plurality of second windings.

2. The transformer as claimed in claim 1 further comprising a fourth winding disposed between the first bobbin and the second bobbin, wherein the plurality of second windings generate the high voltage signals induced from the first winding, the third winding and the fourth winding.

3. The transformer as claimed in claim 1 further comprising a plurality of separators disposed around the exterior of the second bobbin, separation provided thereby accommodating the second windings.

4. A voltage supply circuit for a plurality of lighting tubes, comprising:

a coupling iron core;

a first winding around the coupling iron core receiving a first voltage signal;

a first bobbin disposed between the first winding and the coupling iron core;

a second winding around the exterior of the first winding inductively generating a second voltage signal;

a second bobbin disposed between the first winding and the second winding;

a third winding disposed between the first bobbin and the second bobbin, wherein the second winding generates the second voltage signal induced from the first winding and the third winding; and a plurality of first lighting tubes, connected in series and driven by the second voltage signal.

5. The voltage supply circuit as claimed in claim 4 further comprising a fourth winding disposed between the first bobbin and the second bobbin, wherein the second winding generates the second voltage signal induced from the first winding, the third winding and the fourth winding.

6. The voltage supply circuit as claimed in claim 4 further comprising a plurality of separators disposed around the exterior of the second bobbin, separation provided thereby accommodating the second winding.

7. The voltage supply circuit as claimed in claim 4, wherein the first lighting tubes are connected in serial with and driven by the second voltage signal.

8. A voltage supply circuit, appropriate for a plurality of lighting tubes, comprising:

a coupling iron core;

a first winding around the coupling iron core receiving a first voltage signal;

a plurality of second windings, independent of each other, respectively winding around the exterior of the first winding, and inductively generating a plurality of second voltage signals, wherein the second windings have the same winding number;

a second bobbin disposed between the first winding and the second winding;

a third winding disposed between the first bobbin and the second bobbin, wherein the plurality of second windings generate the plurality of second voltage signals induced from the first winding and the third winding; and a plurality of first lighting tubes, each pair of which is connected in series and driven by one of the second voltage signals.

9. The voltage supply circuit as claimed in claim 8, wherein the first lighting tubes are discharge lighting tubes.

10. The voltage supply circuit as claimed in claim 8 further comprising a plurality of second lighting tubes respectively connected in serial with the first lighting tubes.

11. The voltage supply circuit as claimed in claim 8, wherein the first lighting tubes and the second lighting tubes are discharge lighting tubes.

12. The voltage supply circuit as claimed in claim 8 further comprising a fourth winding disposed between the first bobbin and the second bobbin, wherein the plurality of second windings generate the plurality of second voltage signals induced from the first winding, the third winding and the fourth winding.

13. The voltage supply circuit as claimed in claim 8 further comprising a plurality of separators disposed around the exterior of the second bobbin, separation provided thereby accommodating the second winding.

* * * * *